United States Patent [19]

McCormick

[11] Patent Number: 4,795,382

[45] Date of Patent: Jan. 3, 1989

[54] MARINE DRIVE LOWER UNIT WITH THRUST BEARING ROTATION CONTROL

[75] Inventor: Daniel F. McCormick, Oshkosh, Wis.

[73] Assignee: Brunswick Corporation, Skokie, Ill.

[21] Appl. No.: 162,191

[22] Filed: Feb. 29, 1988

[51] Int. Cl.[4] ..... B63H 5/10

[52] U.S. Cl. ..... 440/81; 74/410; 74/665 K; 416/129

[58] Field of Search ..... 440/75, 81, 83; 74/665 K, 410; 416/128, 129 R, 129 A; 384/303, 304

[56] References Cited

U.S. PATENT DOCUMENTS

| | | | |
|---|---|---|---|
| 2,064,195 | 12/1936 | Michelis | 440/81 |
| 2,406,460 | 8/1946 | Guerke | 416/129 |
| 2,987,031 | 6/1961 | Odden | 440/81 |
| 4,529,387 | 7/1985 | Brandt | 440/66 |

*Primary Examiner*—Sherman D. Basinger

*Attorney, Agent, or Firm*—Andrus, Sceales, Starke & Sawall

[57] ABSTRACT

A marine drive unit (1) includes a lower gear case (8) forming a torpedo housing (9). A pair of coaxial propeller shafts (21, 25) are rotatably mounted in the housing and carry a pair of propellers (10, 11) thereon. The propeller shafts are driven by a pair of opposed driving gears (16, 24) suitably connected through a generally vertical main drive shaft (14) to a marine engine (4) and mounted on the horizontal drive axis (17). A pair of thrust bearings (44, 45) adapted to carry forward thrust loads are respectively disposed adjacent the facing portions of the opposed driving gears, with the pair being separated by a spacer (46) tightly confined therebetween. The spacer is locked against rotation but is freely floatable in an axial direction, and transfers the forward thrust load from one bearing to the other, so that the load is ultimately transferred from the outer propeller shaft (25) to the inner central shaft (21). The result is to reduce the rotational speed of each thrust bearing, in this instance by half.

8 Claims, 1 Drawing Sheet

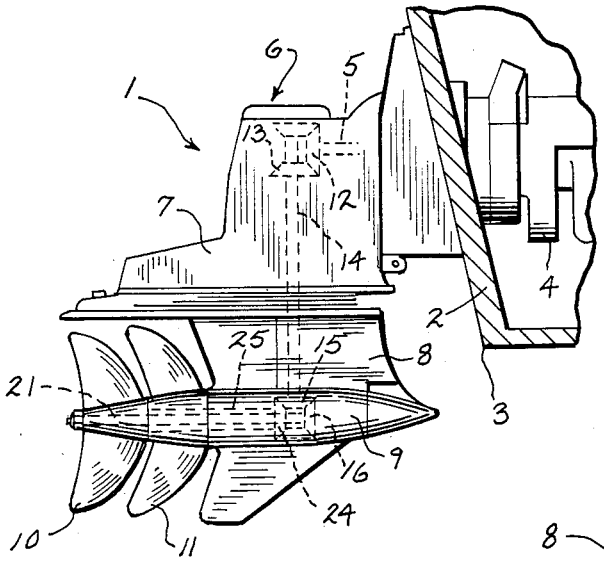
FIG. 1
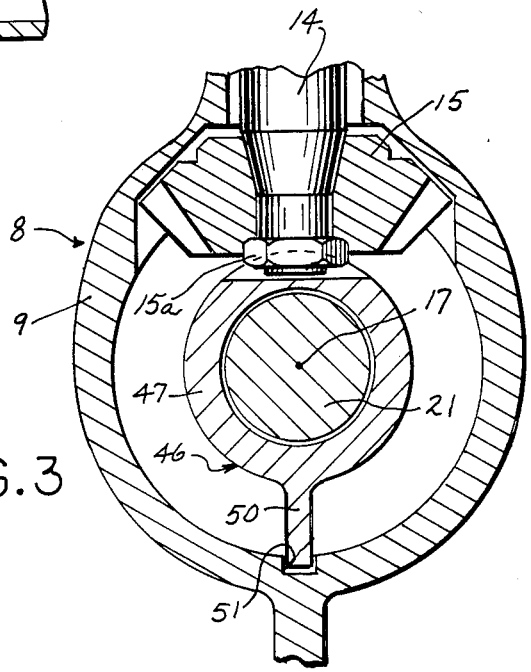
FIG. 3
FIG. 2
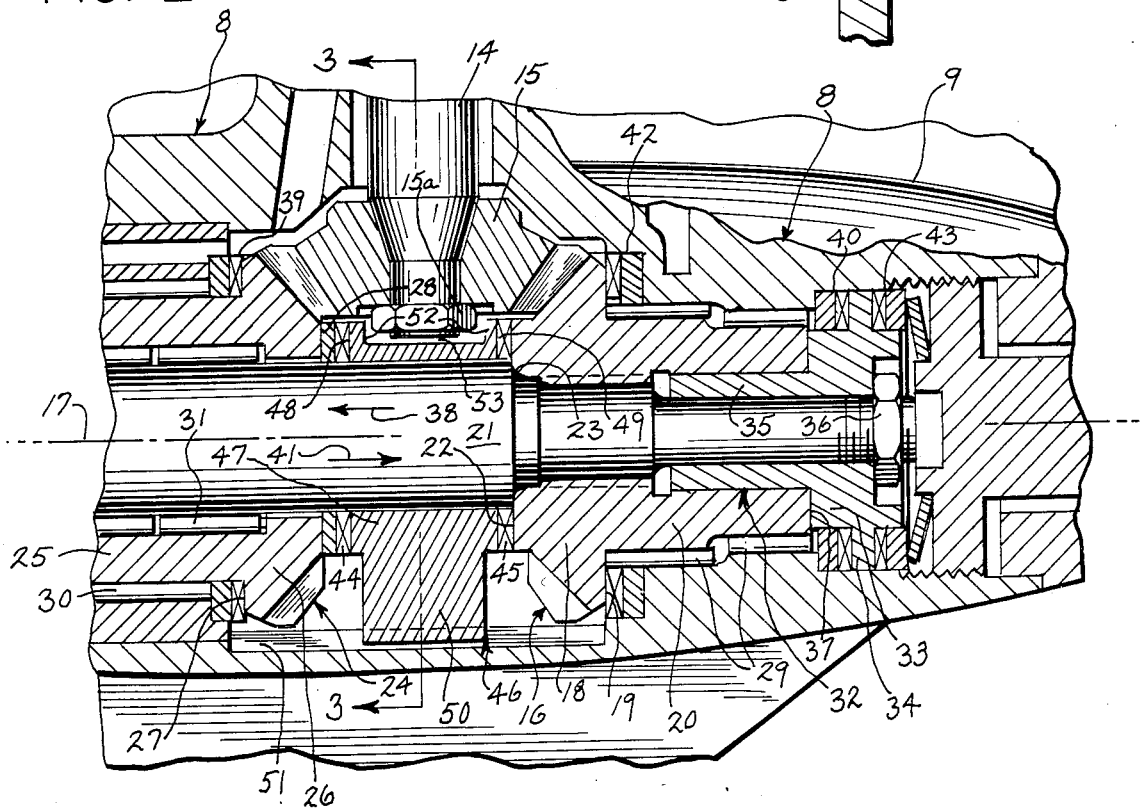

MARINE DRIVE LOWER UNIT WITH THRUST BEARING ROTATION CONTROL

BACKGROUND AND SUMMARY OF THE INVENTION

This invention relates to a marine drive lower unit with thrust bearing rotation control.

Marine drives normally include an outboard positioned drive unit which includes a gear case for mounting a vertical main drive shaft connected at its upper end to a source of power, such as a marine engine. The lower portion of the drive shaft passes through a lower gear case portion which, in turn, is constructed in a manner to provide a generally horizontal torpedo housing. In the system under consideration here, the housing serves to mount a pair of coaxial propeller shafts which are driven by the main drive shaft and which drivingly rotate a pair of contra-rotating marine propellers which are disposed generally aft of the gear case.

Heretofore, and as illustrated in U.S. Pat. No. 4,529,387, the forward thrust load on the outer shaft for one of the propellers has been carried to the central inner shaft for the other propeller via a single thrust bearing disposed aft of the main drive shaft and mounted directly between the propeller shafts. Because these propeller shafts are driven in a contra-rotating manner, the effective speed on the bearing has necessarily been very high, thus adversely affecting bearing life unless a relatively large size and capacity bearing is utilized.

It is an object of the invention to provide a control for the rotation of the bearing device which transfers forward thrust from the outer to inner propeller shaft, and with the control effectively reducing the rotational speed of the bearing device to reduce the required size and extend the life thereof.

In accordance with the various aspects of the invention, a marine drive unit includes a lower gear case forming a torpedo housing. A pair of coaxial propeller shafts are rotateably mounted in the housing and carry a pair of propellers thereon. The propeller shafts are driven by a pair of opposed driving gears suitably connected through a generally vertical main drive shaft to a marine engine and mounted on the horizontal drive axis. A pair of thrust bearings adapted to carry forward thrust loads are respectively disposed adjacent the facing portions of the opposed driving gears, with the pair being separated by a spacer tightly confined therebetween. The spacer is locked against rotation but is freely floatable in an axial direction, and transfers the forward thrust load from one bearing to the other, so that the load is ultimately transferred from the outer propeller shaft to the inner central shaft. The result is to reduce the rotational speed of each thrust bearing, in this instance by half.

The construction is such that the thrust bearings, although each being subject to approximately the full forward thrust load from the outer propeller shaft, can nevertheless be of reduced size and capacity, as compared to the prior known device.

BRIEF DESCRIPTION OF THE DRAWINGS

The accompanying drawings illustrate the best mode presently contemplated by the inventor for carrying out the invention.

In the drawings:

FIG. 1 is a schematic side elevational view of a marine stern drive unit which incorporates the various aspects of the invention;

FIG. 2 is an enlarged fragmentary vertical generally sectional view of an intermediate portion of the torpedo housing; and FIG. 3 is a transverse vertical section taken on line 3—3 of FIG. 2.

DESCRIPTION OF THE PREFERRED EMBODIMENT

As best shown in FIG. 1 of the drawings, and in the present embodiment, the various aspects of the invention are contemplated for utilization in a marine stern drive unit 1 adapted to be suitably mounted to the transom 2 of a boat 3. An internal combustion engine 4 is disposed within the boat and includes an output with a shaft 5 which extends through transom 2 to unit 1, in the usual manner.

Stern drive unit 1 generally includes a stern drive housing 6 forming an upper gear case 7, a lower gear case 8 suitably mounted to gear case 7, and a generally horizontally fore-to-aft extending torpedo housing 9 forming a portion of and disposed at the bottom of gear case 8.

A pair of coaxially mounted propellers 10 and 11 are mounted for rotation generally aft of housing 9. For purposes of driving propellers 10 and 11, a pinion 12 is disposed on the outer end of shaft 5 and meshes with a gear 13 mounted to the upper end of a vertical main drive shaft 14 within upper gear case 7. Main drive shaft 14 extends downwardly and through lower gear case 8, and is provided with a pinion 15 on its lower end which is held in place by a securement member such as a threaded retaining nut 15*a*. Pinion 15 meshes with a forwardly disposed rearwardly facing driving gear 16 mounted for rotation about a horizontal propeller drive axis 17. Gear 16 includes an annular toothed gear body 18 having a forwardly disposed surface 19, with body 18 merging into a forwardly extending sleeve 20. Gear 16 is splined or otherwise mounted on and for rotation with a central axial longitudinally extending first propeller shaft 21. (See FIG. 2) Gear body 18 is also provided with an annular rear face 22 which is normally in engaging relationship with a forwardly facing shoulder 23 on shaft 21.

Furthermore, pinion 15 meshes with a rearwardly disposed forwardly facing driving gear 24 which is also mounted for rotation about drive axis 17. As shown, gear 24 forms the forward end portion of a longitudinally extending second propeller shaft 25 and includes an annular toothed gear body 26 having a rearwardly disposed surface 27 and an annular front face 28. Front face 28 is disposed in opposed relation to face 22. Second propeller shaft 25 is generally tubular and concentric with shaft 21.

As schematically shown in FIG. 1, rear propeller 10 is mounted to the rearward end of central first propeller shaft 21, while front propeller 11 is mounted to the rearward end of second propeller shaft 25, in any suitable well known manner. The result in this instance is to provide contra-rotating propellers.

Forward gear 16 and shaft 21 are supported for rotation in housing 9 by suitable support bearings 29, while rearward gear 24 and shaft 25 are likewise supported by support bearings 30 and 31.

An annular bearing adapter 32 is disposed at the forward end portion of gear 16 and comprises an enlarged body 33 having a radially extending annular collar 34. Body 33 merges rearwardly into a sleeve portion 35 of reduced diameter which is concentrically and slidingly disposed between sleeve 20 of gear 16 and propeller shaft 21. A nut 36 is threadably mounted to the forward end of shaft 21 and serves to clamp adapter body 33 against the abutment formed by the forward terminus 37 of sleeve 20. Thus, gear 16 and adapter 31 will rotate together.

Reverse thrust, as illustrated by the arrow 38, is carried by reverse thrust bearing means. As shown in FIG. 2, an annular ring-like roller-type thrust bearing assembly 39 is confined between surface 27 of driving gear 24 and a portion of gear case 8. Likewise, a similar thrust bearing assembly 40 is confined between the rearward side of bearing adapter collar 34 and a portion of the gear case. Reverse thrust forces 38 on shaft 21 are transmitted to bearing assemblies 39 and 40.

In addition, forward thrust bearing means are provided to carry the forward thrust forces, illustrated by the arrow 41, on shaft 21. For this purpose, a thrust bearing assembly 42 of generally similar type is confined between surface 19 of driving gear 16 and a portion of gear case 8. Forward thrust in the direction of arrow 41 is transmitted from propeller shaft 21 and through shoulder 23 to rearward gear surface 22 of gear 16, and hence from forward gear surface 19 to bearing assembly 42. In the embodiment shown, forward thrust is only partially and selectively carried by bearing assembly 42. A pre-loaded second forward thrust bearing assembly 43 also carries part of the load. Reference is made to the present inventor's co-pending U.S. patent application Ser. No. 162,181, entitled "MARINE DRIVE LOWER UNIT WITH SEQUENTIALLY LOADED MULTIPLE THRUST BEARINGS", filed on even date herewith.

It is contemplated that the forward thrust forces are to be transferred from outer propeller shaft 25 to central propeller shaft 21, with the ultimate forward thrust load being carried by the associated elements including gear 16, adapter 32 as well as bearing assemblies 42 and 43 which are disposed forwardly of gear 16. Thus, and in accordance with the various aspects of the invention, means are provided to transfer the forward thrust forces from shaft 25 and its associated gear 24 and hence to gear 16 and its associated shaft 21.

For the above purpose, a first and rearwardly positioned annular thrust bearing assembly 44 of any well-known type is disposed adjacent front face 28 of rear driving gear 24. Likewise, a second and forwardly positioned annular thrust bearing assembly 45 of similar type is disposed adjacent rear face 22 of front driving gear 16. Bearing assemblies 44 and 45 are axially spaced, with assembly 44 being disposed rearwardly of main drive shaft 14 and assembly 45 being disposed forwardly thereof in the present embodiment.

Means are provided to transfer the forward thrust load from bearing assembly 44 to assembly 45. For this and other purposes, a load transferring spacer 46 is clampingly sandwiched between the assemblies. As best seen in FIGS. 2 & 3, and in the present embodiment, spacer 46 comprises a generally cylindrical central body portion 47 mounted coaxially about propeller shaft 21 and having end edges 48 and 49 which engage bearing assemblies 44 and 45 respectively. A key 50 extends radially outwardly from body portion 47 and engages within a longitudinal slot 51 in gear case 8. Slot 51 extends generally between gears 16 and 24. The construction is such as to fix spacer 46 against rotation while it remains free to float longitudinally along axis 17. The extent of axial movement of spacer 46 is limited by the opposed edges 52 of a recess 53 disposed in spacer body portion 47 and which receives main drive shaft nut 15*a*.

Spacer 46 is located on its axis by bearing assemblies 44 and 45 acting together and, during operation of the device, serves to transfer the forward thrust from assembly 44 associated with outer propeller shaft 25 to assembly 45 which is associated with inner propeller shaft 21.

By placing a forward thrust bearing assembly 44, 45 on each side of the non-rotatable spacer 46, the rotational velocity or speed of each bearing assembly is only one-half the speed of a single bearing assembly joining the propeller shafts directly, as in the aforementioned U.S. Patent. Bearing assembly 44 is only subject to unidirectional rotational forces from the single propeller shaft 25, while bearing assembly 45 is only subject to unidirectional rotational forces associated with the single propeller shaft 21. The size of each bearing assembly may therefor be reduced without reducing its effective life. And yet, both bearing assemblies carry the full forward thrust load. Various modes of carrying out the invention are contemplated as being within the scope of the following claims which particularly point out and distinctly claim the subject matter regarded as the invention.

I claim:

1. In a marine drive, the combination comprising:

(a) a generally vertical gear case (7, 8) terminating in a lower torpedo housing (9), (b) a first propeller shaft (21) disposed within said housing and extending longitudinally in a fore-to-aft direction and rotatable on a longitudinal drive axis (17), (c) a second propeller shaft (25) concentric with said first shaft and adapted for contra-rotation relative to the latter, (d) propeller means (10, 11) mounted respectively to said shafts (21, 25), (e) drive means for connecting said propeller shafts to a marine engine and with said drive means including:

(1) an engine rotatable pinion (15), (2) a rearwardly positioned driving gear (24) meshing with said pinion and disposed for rotation with said second shaft (25), (3) and a forward driving gear (16) spaced forwardly from said rearward driving gear and meshing with said pinion, said forward driving gear being disposed for rotation with said first shaft (21), (4) said rearward and forward driving gears (24, 16) having respective opposed inner faces (28, 22), (f) forward thrust bearing means (44, 45) mounted adjacent each said respective inner face (28, 22), (g) forward thrust transmitting spacer means (46) coaxial with said propeller shafts and sandwiched between said forward thrust bearing means, (h) and means (50, 51) fixing said spacer means against rotation about said axis while permitting floating longitudinal spacer movement.

2. The combination of claim 1 wherein said last-named means (h) comprises:

(a) a longitudinal spacer body (47) forming part of said spacer means, (b) a longitudinal slot (51) disposed in said gear case, (c) and key means (50) extending from said spacer body into said slot.

3. The combination of claim 2 wherein said spacer body (47) is mounted about said first propeller shaft (21).

4. The combination of claim 1 wherein said forward thrust bearing means (44, 45) together form means for locating said spacer means along said axis.

5. The combination of claim 4 which includes means (15*a*, 52, 53) limiting axial floating movement of said spacer means (46).

6. The combination of claim 5:

(a) in which said drive means includes a generally vertical main drive shaft (14), (b) which includes a securement member (15*a*) mounting said pinion (15) at the lower end of said drive shaft, (c) and wherein said limiting means comprises a recess (53) disposed in said spacer means (46) with said recess having opposed walls (52) engageable with said securement member.

7. The combination of claim 6 in which one of said bearing means (44) is disposed generally rearwardly of said main drive shaft (14) and the other of said bearing means (45) is disposed generally forwardly of said last-named shaft.

8. The combination of claim 1, 3, 4 or 5 wherein the construction is such that each of said forward thrust bearing means (44, 45) are subjected to unidirectional rotational forces.

* * * * *